US006383042B1

(12) United States Patent
Neisen

(10) Patent No.: US 6,383,042 B1
(45) Date of Patent: May 7, 2002

(54) AXIAL TWIST PROPELLER HUB

(75) Inventor: Gerald F. Neisen, Rockport, TX (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/547,009

(22) Filed: Apr. 11, 2000

(51) Int. Cl.[7] ..... B63H 1/14; B63H 23/34
(52) U.S. Cl. ..... 440/49; 440/83; 416/134 R
(58) Field of Search ..... 440/49, 79, 83; 416/93 A, 134 R, 245 A, 244 B

(56) References Cited

U.S. PATENT DOCUMENTS 4,566,855 A * 1/1986 Costabile et al. ..... 416/134 R
5,201,679 A * 4/1993 Velt, Jr. et al. ..... 440/49
5,252,028 A * 10/1993 LoBosco et al. ..... 416/93 A
5,630,704 A * 5/1997 Gilgenbach et al. .... 416/134 R
5,967,751 A * 10/1999 Chen ..... 416/93 A

* cited by examiner

*Primary Examiner*—S. Joseph Morano
*Assistant Examiner*—Andy Wright
(74) *Attorney, Agent, or Firm*—Armstrong Teasdale LLP

(57) ABSTRACT

A propeller assembly that includes an interchangeable drive sleeve, a resilient inner hub having a bore in which the drive sleeve is inserted, and a propeller including an outer hub in which the drive sleeve and resilient inner hub are inserted, is described. In an exemplary embodiment, the drive sleeve includes a cylindrical shaped body and a plurality of splines extend from an outer diameter surface of drive sleeve body. A bore extends through drive sleeve, and a plurality of grooves are in an inner diameter surface of the drive sleeve bore. These grooves are configured to mate with splines on a propeller shaft. Resilient inner hub includes a cylindrical shaped body and a plurality of tapered grooves in an inner diameter surface of the inner hub body. Each groove is arranged to receive one drive sleeve spline. The inner hub also includes a drive flange at one end thereof. The propeller includes an outer hub having a cylindrical shaped body, and a plurality of blades extend from an outer diameter surface of the outer hub body. An inner diameter surface of the outer hub body is shaped to mate with the inner hub drive flange to limit relative movement between the inner hub drive flange and the outer hub.

31 Claims, 5 Drawing Sheets

AXIAL TWIST PROPELLER HUB

BACKGROUND OF THE INVENTION

The invention relates generally to marine engines, and more particularly, to propeller hubs.

Outboard engines include a drive shaft which extends from the engine power head, through an exhaust case, and into an engine lower unit. The lower unit includes a gear case, and a propeller shaft extends through the gear case. Forward and reverse gears couple the propeller shaft to the drive shaft. The drive shaft, gears, and propeller shaft sometimes are referred to as a drive train.

A propeller is secured to and rotates with the propeller shaft. Torque from the propeller is transmitted to the shaft. Specifically, propeller hub assemblies transmit torque to the propeller shaft. Exemplary propeller hub assemblies include cross bolts, keys, shear pins, plastic hubs, and compressed rubber hubs. Such hub assemblies should have sufficient strength or stiffness so that during normal engine operations, very few losses occur between the propeller shaft and the propeller. Such hub assemblies, however, also should be resilient so that the engine drive train is protected in the event of an impact, e.g., if the propeller hits a log or rock.

A propeller hub assembly also should facilitate "limp home" operation of the engine so that even in the event that an interface between the propeller shaft and the propeller shears due to a large impact, the propeller and propeller shaft still remain sufficiently engaged so that the engine still drives the boat, for example, to return to a dock for repairs. Further, since engine manufacturers often utilize different propeller shaft arrangements, it would be desireable to provide propeller hub assemblies that facilitate use of one propeller on engines of different engine manufacturers.

BRIEF SUMMARY OF THE INVENTION

These and other objects may be attained by a propeller assembly that includes an interchangeable drive sleeve, a resilient inner hub having a bore in which the drive sleeve is inserted, and a propeller including an outer hub in which the drive sleeve and resilient inner hub are inserted. In an exemplary embodiment, the drive sleeve includes a cylindrical shaped body and a plurality of splines extend from an outer diameter surface of drive sleeve body. A bore extends through drive sleeve, and a plurality of grooves are in an inner diameter surface of the drive sleeve bore. These grooves are configured to mate with splines on a propeller shaft.

Resilient inner hub includes a cylindrical shaped body and a plurality of tapered grooves in an inner diameter surface of the inner hub body. Each groove is arranged to receive one drive sleeve spline. The inner hub also includes a drive flange at one end thereof.

The propeller includes an outer hub having a cylindrical shaped body, and a plurality of blades extend from an outer diameter surface of the outer hub body. An inner diameter surface of the outer hub body is shaped to mate with the inner hub drive flange to limit relative movement between the inner hub drive flange and the outer hub.

For limp home operation, the drive sleeve includes a flange at one end of the drive sleeve cylindrical shaped body, and a plurality of limp home projections, or drive arms, extend from the drive sleeve flange. A plurality of limp home projections, or drive arms, also extend from the outer hub inner diameter surface.

During operation, and upon the occurrence of an impact, resilient hub twists along its axial length, and drive sleeve splines progressively come into contact with side walls of grooves in inner hub. When the splines are in contact with one groove side wall along the entire length of wall, such contact limits further twisting by inner hub. The operational condition in which hub is twisted along its axial length as described above is sometimes referred to herein as the resilient operation mode.

If the impact forces are sufficient, it is possible that the splines will shear. In the event that all splines shear, then the propeller shaft and drive sleeve rotate relative to the propeller outer hub until the limp home arm projections of the drive sleeve and outer hub come into contact. If the forces are not sufficient to also shear the limp home projections, then the propeller will resume rotating with the propeller shaft. Such operational condition is sometimes referred to herein as the limp home operation mode.

In addition to operating in both a resilient mode to protect the engine drive train from damage, and a limp home mode so that even in the event that the propeller strikes an object in the water, the propeller is still operational, the above described propeller assembly facilitates the easy replacement of the resilient hub. Specifically, in the event that the inner hub needs to be replaced, a user simply removes the propeller assembly from the propeller shaft, and removes the drive sleeve and resilient hub from within the outer hub. A replacement inner hub can then be utilized when reassembling the propeller assembly and mounting the assembly on the propeller shaft.

Further, different drive sleeves can be provided so that the propeller can be utilized on many different types of marine engines. For example, one particular marine engine may have splines on the propeller shaft of a first length, and another particular marine engine may have splines on a propeller shaft of a second length. Different drive sleeves having different length splines on their inner diameter surfaces can be provided. Although different drive sleeves a reutilized, a same propeller can be used. That is, by providing inter changeable drive sleeves, one propeller can be used in conjunction with many different type engines.

DETAILED DESCRIPTION OF THE INVENTION

The present invention is not limited to practice in connection with a particular engine, nor is the present invention limited to practice with a particular propeller configuration. The present invention can be utilized in connection with many engines and propeller configurations. For example, a propeller having three blades is described herein. The present invention, however, can be used in connection with propellers having any number of blades. Therefore, although the invention is described below in the context of an exemplary outboard engine and propeller configuration, the invention is not limited to practice with such engine and propeller.

Figure 1:
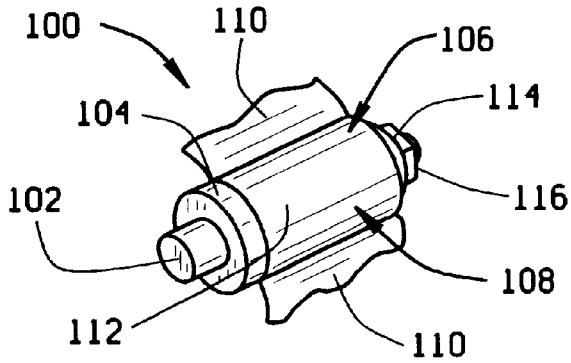
FIG. 1 is a front perspective view of a propeller assembly in accordance with one embodiment of the present invention.

FIG. 1 is a front perspective view of a propeller assembly 100 in accordance with one embodiment of the present invention. Propeller assembly 100 is configured for being secured to a propeller shaft 102 of a marine engine. Propeller assembly 100 includes a thrust washer 104, a propeller 106 having an outer hub 108 and a plurality of blades 110 extending from an outer diameter hub surface 112, a washer 114, and a nut 116 which secures assembly 100 to propeller shaft 102.

Generally, propeller assembly 100 rotates with propeller shaft 102 during normal operations. In the event of an impact, e.g., propeller 106 strikes an object in the water, propeller 106 may rotate relative to shaft 102 as described below in more detail to protect the engine drive train. In addition, and in the event that such relative rotation of propeller 106 results in shearing the primary engagement between propeller 106 and propeller shaft 102, a limp home arrangement provides that propeller 106 may still be rotatable with propeller shaft 102 so that the operator can at least reach a dock for repairs.

Figure 2:
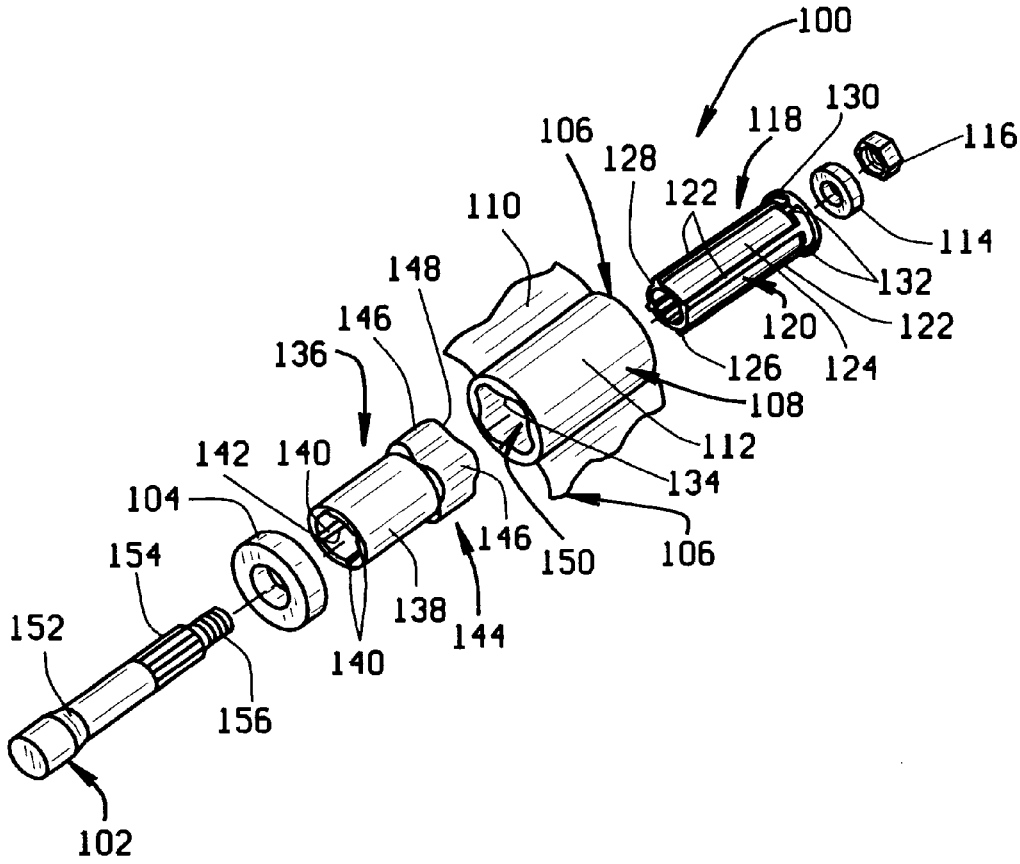
FIG. 2 is an exploded view of the propeller assembly shown in FIG. 1.

FIG. 2 is an exploded view of propeller assembly 100. As shown in FIG. 2, assembly 100 also includes a drive sleeve 118 having a cylindrical shaped body 120. Drive sleeve 118 extends from thrust washer 104 to washer 114. Tightening of nut 116 pre-loads sleeve 118 to eliminate propeller rattle and wear, which facilitates eliminating damaging wear on load carrying thrust washer 104.

A plurality of splines 122 extend from an outer diameter surface 124 of drive sleeve body 120. A plurality of grooves 126 are in an inner diameter surface 128 of drive sleeve cylindrical shaped body 120. A flange 130 is at one end of drive sleeve cylindrical s h aped body 120, and a plurality of limp home projections 132 extend from drive sleeve flange 130. Although not shown in FIG. 1, a plurality of limp home projections extend from an outer hub inner diameter surface 134 to provide limp home operation, as described below in more detail. In an exemplary embodiment, drive sleeve 118 is cast from bronze.

Assembly also includes a resilient inner hub 136 having a cylindrical shaped body 138. A plurality of grooves 140 are formed in an inner diameter surface 142 inner hub body 138, and each groove 140 is located, or arranged, to receive one drive sleeve spline 122. Grooves 140 are tapered, as described hereinafter in more detail, to enable maximum torsional twisting and even stress distribution along hub 136 in the event of a significant impact.

A drive flange 144 is located at one end of inner hub body 138. Flange 144 is shaped to tightly mate with outer hub 108. Specifically, and in the embodiment shown in FIG. 2, flange 144 has four projections 146 spaced by intermediate sections 148. Outer hub bore 150 is shaped so that flange 144 tightly fits within bore 150. Body 138 has an outer diameter less than an inner diameter of bore 150. Therefore, flange 144 tightly fits with outer hub 108, but body 138 can rotate relative to hub 108.

More specifically, and with respect to a longitudinal axis of resilient hub 136, body 138 axially twists along such axis in the event of an impact, as described below in more detail. To facilitate such axial twisting, which protects the engine drive train, hub 136 is fabricated from resilient material. An exemplary resilient material suitable for fabrication of hub is a plastic. Of course, other resilient material can be used.

Assembly further includes propeller 106 having outer hub 108 with a cylindrical shape. Blades 110 extend from outer diameter surface 112 of outer hub 108. As explained above, bore 150 extends through hub 108 and is shaped to mate with inner hub drive flange 144 to limit relative movement between inner hub drive flange 144 and outer hub 108. Propeller 106 can be cast from aluminum, stainless steel, or other materials.

Propeller shaft 102 has a tapered section 152 for mating with thrust washer 104, and a splined section 154 for mating with drive sleeve grooves 126. Propeller shaft 102 also includes a threaded section 156 for engagement with nut 116. Different engines may have different length splined sections, and as described below in more detail, by simply using a mating drive sleeve, one propeller (e.g., propeller 106) can be used on such different engines.

Figure 3:
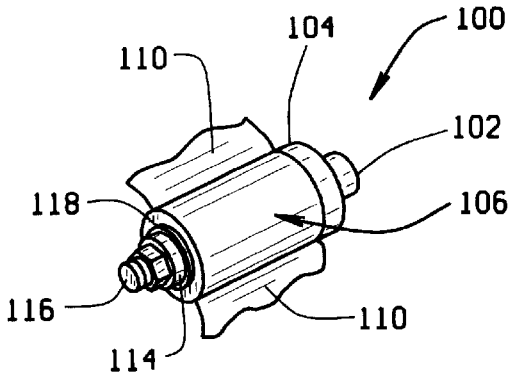
FIG. 3 is a rear perspective view of the propeller assembly shown in FIG. 1.

FIG. 3 is a rear perspective view of propeller assembly 100. To secure propeller 106 to propeller shaft 102, drive sleeve 118 and resilient inner hub 136 (FIG. 3) are inserted into outer hub bore 150. Drive sleeve 118 can first be inserted into inner hub 136 to form a subassembly, and then the subassembly is inserted into outer hub bore 150. Alternatively, inner hub 136 can first be inserted into outer hub bore 150, and then drive sleeve 118 is inserted into inner hub 136.

Thrust washer 104 and propeller 106, inner hub 136, and drive sleeve 118 assembly are then pushed over propeller shaft 102 so that propeller shaft 102 extends through and engages drive sleeve 118. Washer 114 is then pushed over shaft 102, and threaded nut 116 is tightened on shaft 102 to secure propeller 106 to shaft 102. As shown in FIG. 3, nut 116 is tightened on propeller shaft 102 so that washer 114 is tightly secured against drive sleeve flange 130.

Figure 4:
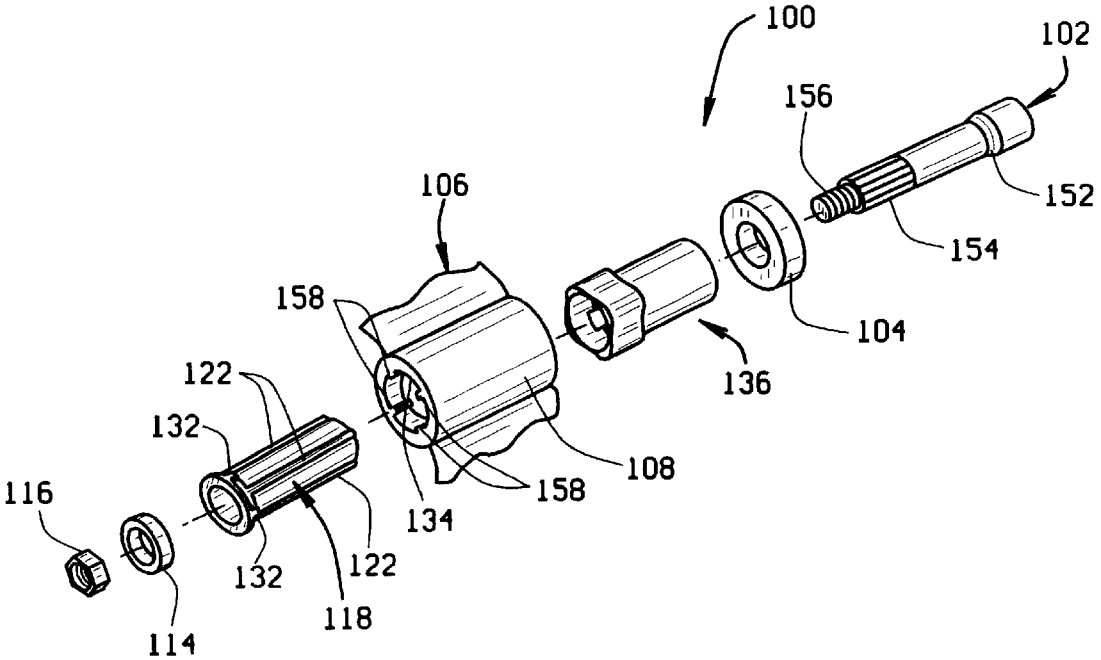
FIG. 4 is an exploded view of the propeller assembly shown in FIG. 3.

FIG. 4 is an exploded view of propeller assembly 100. As shown in FIG. 4, one or more limp home projections 158 extend from outer hub inner diameter surface 134 to provide limp home operation. Specifically, in the event of an impact and shearing of splines 122, drive sleeve 118 rotates until further rotation is prevented by contact between drive sleeve limp home projections 132 and outer hub limp home projections 158. Upon contact, outer hub 108 begins to once again rotate with drive sleeve 118. Limp home projections 132 and 158 provide sufficient strength so that propeller 106 continues to rotate at low speeds without shearing of projections 132 and 158. Projections 132 and 158 therefore facilitate continued operation of propeller 106 even after an impact which results in shearing drive sleeve splines 122.

Figure 5:
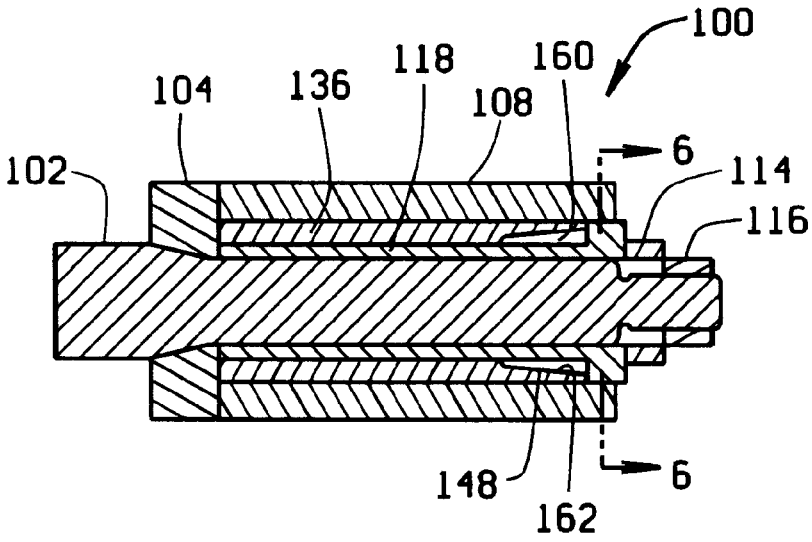
FIG. 5 is a side cross-sectional view of the propeller assembly shown in FIG. 1.

FIG. 5 is a side cross-sectional view of propeller assembly 100. As shown in FIG. 5 a gap 160 between drive sleeve 118 and intermediate section 148 of resilient hub flange 144. An inner diameter surface 162 of hub 136 tapers and extends between splines (not shown in FIG. 5) of drive sleeve 118.

Figure 6:
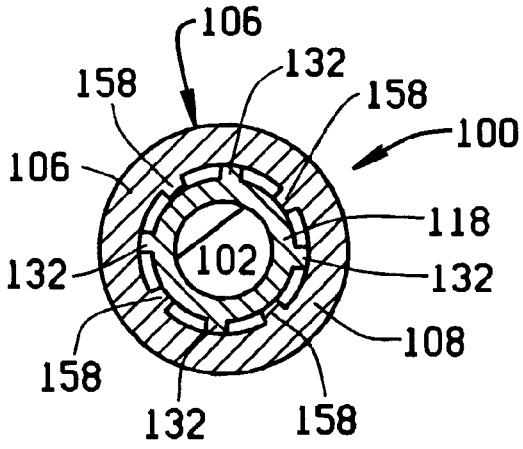
FIG. 6 is a cross-sectional view through line 6—6 shown in FIG. 5.

As shown in FIG. 6, which is a cross-sectional view through line 6—6 shown in FIG. 5, each drive sleeve limp home projection 132 extend into a space between pairs of outer hub limp home projections 158. In the event that drive sleeve splines 122 (FIG. 4) sheer then drive sleeve 118 rotates with propeller shaft 102 and the engagement between propeller outer hub 106 and drive sleeve 118 slips until drive sleeve limp home projections 132 engage hub limp home projections 158. When drive sleeve and outer hub projections 132 and 158 engage, propeller 106 again rotates with propeller shaft 102 due to the engagement between propeller shaft 102, drive sleeve 118, and outer hub 108.

Figure 7:
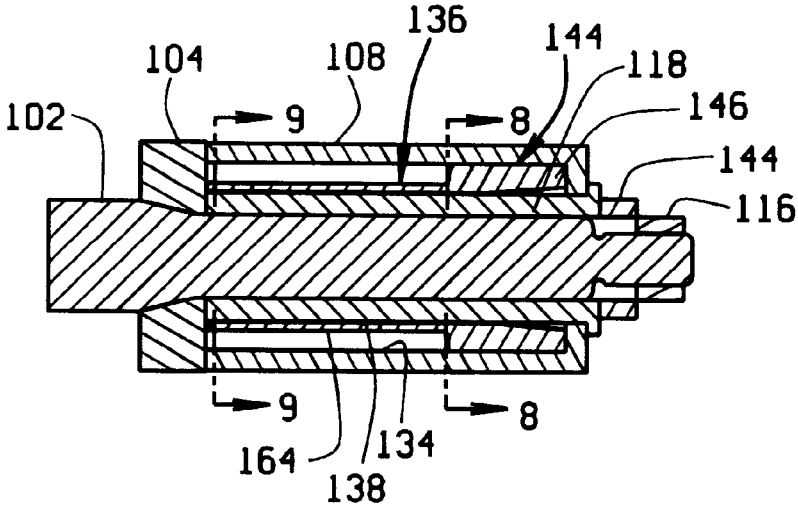
FIG. 7 is a side cross-sectional view of the propeller assembly shown in FIG. 1.

As shown in FIG. 7, resilient inner hub flange projection 146 tightly fits against inner diameter surface 134 of outer hub 108. An outer diameter surface 164 of inner hub cylindrical shaped body 138 is not in contact with outer hub 108, and engages drive sleeve 118 via the groove and spline arrangement described above.

In operation, as propeller shaft 102 rotates, torque from shaft 102 is transferred to drive sleeve 118, and from drive sleeve 118 to resilient inner hub 136. Torque is transferred from resilient inner hub 136 to outer hub 108 at flange 144. In the event that propeller 106 strikes an object, inner resilient hub 136 may twist along a longitudinal axis of propeller shaft 102 due to the tight fit between hub flange 144 and propeller 106 and the gap between inner hub cylindrical body 138 and outer hub 108. Such twisting provides that splines 122 are not necessarily sheared upon the occurrence of the impact, yet the engine drive train is protected.

Figure 8:
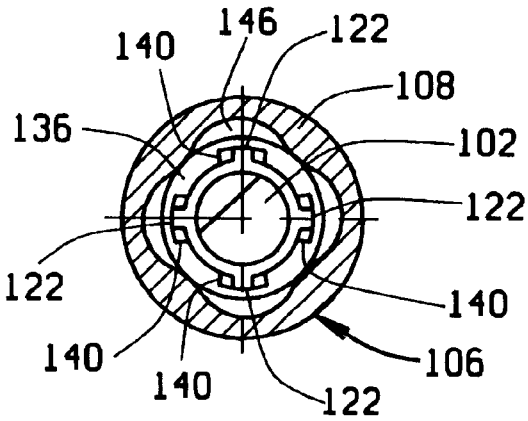
FIG. 8 is a cross-sectional view through line 8—8 shown in FIG. 7.

FIG. 8 is a cross-sectional view through line 8—8 shown in FIG. 7. As shown in FIG. 8, drive sleeve splines 122 at a location adjacent flange 144 are not in contact with side walls of tapered grooves 140 in inner diameter surface 142 of resilient hub 136. As resilient hub 136 twists, however, splines 122 progressively come into contact with such side walls and limit the extent of twisting by inner hub 136.

Figure 9:
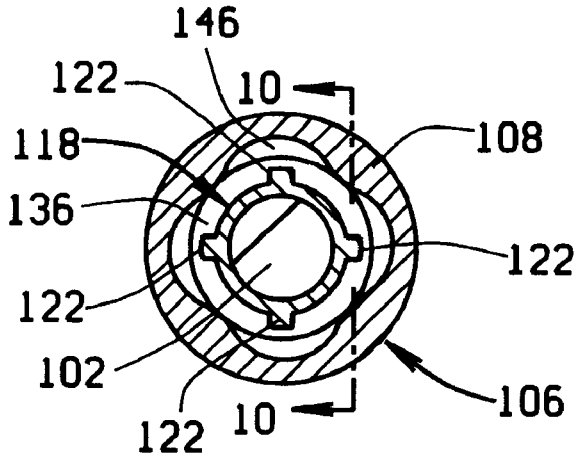
FIG. 9 is a cross-sectional view through line 9—9 shown in FIG. 7.

FIG. 9 is a cross-sectional view through line 9—9 shown in FIG. 7. As shown in FIG. 9, splines 122 are in a tight fit with tapered grooves 130 at an end of inner hub 126 opposite flange 144. Such tight fit is necessary to provide that during normal operations, torque is efficiently transferred from propeller shaft 102 to propeller 106 through drive sleeve 118 and inner hub 136.

Figure 10:
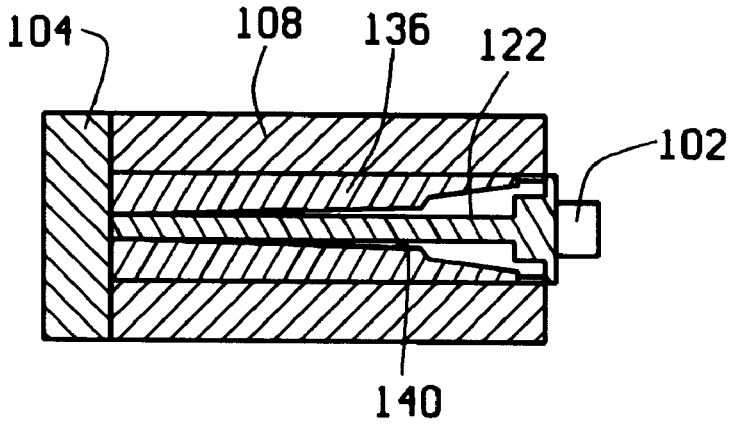
FIG. 10 is a cross-sectional view through line 10—10 shown in FIG. 9.

FIG. 10 is a cross-sectional view through line 10—10 shown in FIG. 9. Drive sleeve spline 122 extends through resilient hub groove 140, and groove 140 is tapered as described above. Again, drive sleeve spline 122 at a location adjacent flange 144 is not in contact with side walls of tapered groove 140, and spline 122 is in a tight fit with tapered groove 140 at an end of inner hub 136 opposite flange 144. The tight fit between spline 122 and groove 140 provides that during normal operations, torque is efficiently transferred from propeller shaft 102 to propeller 106 through drive sleeve 118 and inner hub 136. Such operational condition is sometimes referred to herein as the normal operation mode of propeller assembly 100.

Upon the occurrence of an impact, and as resilient hub 136 twists, spline 122 progressively come into contact with a side wall of groove 140. When spline 122 is in contact with one groove side wall along the entire length of wall, such contact limits further twisting by inner hub 136. The operational condition in which hub 136 is twisted is sometimes referred to herein as the resilient operation mode of propeller assembly 100.

The torsional forces are transmitted along a serpentine path from the end of drive sleeve 118 splined to propeller shaft 102, to hub 136 at the location at which hub 136 is engaged to sleeve 118, and to propeller outer hub 108 at flange 144. This serpentine path provides the advantages of facilitating more even distribution of forces, as well as facilitating absorption of greater forces due to the length of the path as compared to a direct (e.g., radial) path from the shaft to the propeller hub.

If the impact forces are sufficient, it is possible that splines 122 will shear. In the event that all splines 122 shear, then propeller shaft 102 and drive sleeve 118 rotate relative to propeller outer hub 108 until limp home projections 132 and 158 of drive sleeve 118 and outer hub 108 come into contact. If the forces are not sufficient to also shear limp home projections 132 and 158, then propeller 106 will resume rotating with propeller shaft 102. Such operational condition is sometimes referred to herein as the limp home operation mode of propeller assembly 100.

In addition to operating in both a resilient mode to protect the engine drive train from damage, and a limp home mode so that even in the event that the propeller strikes an object in the water, propeller 106 is still operational, propeller assembly 100 facilitates the easy replacement of resilient hub 136. Specifically, in the event that inner hub 136 needs to be replaced, a user simply removes propeller assembly 100 from propeller shaft 102, and removes drive sleeve 118 and resilient hub 136 from within outer hub 108. A replacement inner hub 136 can then be utilized when reassembling propeller assembly 100 and mounting assembly 100 on propeller shaft 102.

Further, different drive sleeves can be provided so that propeller 106 can be utilized on many different types of marine engines. For example, one particular marine engine may have splines on the propeller shaft of a first length, and another particular marine engine may have splines on a propeller shaft of a second length, or a different number of splines or different size splines. Different drive sleeves having different length splines on their inner diameter surfaces can be provided. Although different drive sleeves are utilized, a same propeller can be used. That is, by providing interchangeable drive sleeves, one propeller can be used in conjunction with many different type engines.

It is contemplated that drive sleeve or resilient hub, or both, could be sold in kit form. For example, different kits containing different drive sleeves specified for particular engine types could be provided. In one specific embodiment, a kit includes both a drive sleeve and a resilient replaceable inner hub.

From the preceding description of various embodiments of the present invention, it is evident that the objectives of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A propeller assembly for being secured to a propeller shaft of a marine engine, said propeller assembly comprising:

a drive sleeve comprising a cylindrical shaped body, a plurality of splines extending from an outer diameter surface of said drive sleeve body, a resilient inner hub comprising a cylindrical shaped body, a plurality of grooves in an inner diameter surface of said inner hub body, each said groove arranged to receive one said drive sleeve spline, and a drive flange at one end of said inner hub body, and a propeller comprising an outer hub comprising a cylindrical shaped body, and a plurality of blades extending from an outer diameter surface of said outer hub body, an inner diameter surface of said outer hub body shaped to mate with said inner hub drive flange to limit relative movement between said inner hub drive flange and said outer hub.

2. A propeller assembly in accordance with claim 1 wherein a plurality of grooves are in an inner diameter surface of said drive sleeve cylindrical shaped body.

3. A propeller assembly in accordance with claim 1 wherein said drive sleeve is pre-loaded.

4. A propeller assembly in accordance with claim 1 wherein said drive sleeve further comprises a flange at one end of said drive sleeve cylindrical shaped body.

5. A propeller assembly in accordance with claim 4 further comprising a plurality of limp home projections extending from said drive sleeve flange, and a plurality of limp home projections extending from said outer hub inner diameter surface.

6. A propeller assembly in accordance with claim 1 wherein said grooves in said inner diameter surface of said inner hub body are tapered.

7. A propeller assembly in accordance with claim 1 wherein said resilient inner hub is fabricated from plastic.

8. An interchangeable drive sleeve for a propeller assembly to secure a propeller to a propeller shaft, said drive sleeve comprising a cylindrical shaped body, a plurality of splines extending from an outer diameter surface of said drive sleeve body, a plurality of splines extending from an inner diameter surface of said drive sleeve cylindrical shaped body, a flange at one end of said drive sleeve cylindrical shaped body, and a plurality of limp home projections extending from said flange.

9. An interchangeable drive sleeve in accordance with claim 8 wherein an inner diameter of said sleeve is selected based on an outer diameter of the propeller shaft.

10. An interchangeable drive sleeve in accordance with claim 8 wherein a longitudinal length of said splines extending from said drive sleeve body inner diameter surface is selected based on a length of splines extending from an outer diameter surface of the propeller shaft.

11. A resilient replaceable inner hub for a propeller assembly to secure a propeller to a propeller shaft, said inner hub comprising a cylindrical shaped body, a plurality of grooves in an inner diameter surface of said inner hub body, and a drive flange at one end of said inner hub body.

12. A resilient replaceable inner hub in accordance with claim 11 wherein said grooves in said inner hub body inner diameter surface are tapered.

13. A resilient replaceable inner hub in accordance with claim 11 wherein said drive flange is configured to mate with an inner diameter surface of a propeller outer hub, and wherein said cylindrical shaped body is configured to twist about a longitudinal axis thereof.

14. A propeller assembly in accordance with claim 11 wherein said resilient inner hub is fabricated from plastic.

15. A kit for securing a propeller to a propeller shaft of a marine engine, said kit comprising:

an interchangeable drive sleeve comprising a cylindrical shaped body, a plurality of splines extending from an outer diameter surface of said drive sleeve body, a plurality of splines extending from an inner diameter surface of said drive sleeve cylindrical shaped body, and a flange at one end of said drive sleeve cylindrical shaped body, and a resilient replaceable inner hub comprising a cylindrical shaped body, a plurality of grooves in an inner diameter surface of said inner hub body, and a drive flange at one end of said inner hub body.

16. A kit in accordance with claim 15 wherein said interchangeable drive sleeve further comprises a plurality of limp home projections extending from said flange.

17. A kit in accordance with claim 15 wherein an inner diameter of said drive sleeve is selected based on an outer diameter of the propeller shaft.

18. A kit in accordance with claim 15 wherein a longitudinal length of said splines extending from said drive sleeve body inner diameter surface is selected based on a length of splines extending from an outer diameter surface of the propeller shaft.

19. A kit in accordance with claim 15 wherein said grooves in said inner hub body inner diameter surface of said resilient replaceable inner hub are tapered.

20. A kit in accordance with claim 15 wherein said drive flange is configured to mate with an inner diameter surface of a propeller outer hub, and wherein said cylindrical shaped body is configured to twist about a longitudinal axis thereof.

21. A kit in accordance with claim 15 wherein said resilient inner hub is fabricated from plastic.

22. A method for securing a propeller to a propeller shaft of a marine engine with a drive sleeve including at least one limp home projection extending therefrom, the propeller including an outer hub having at least one limp home projection extending therefrom, said method comprising the steps of:

inserting a drive sleeve and a resilient hub into an outer hub of a propeller such that the limp home projection of the drive sleeve is aligned with the limp home projection of the outer hub, the resilient hub being torsionally twistable relative to the drive sleeve, and pushing the drive sleeve, resilient hub, and propeller over the propeller shaft so that the propeller shaft extends through and engages the drive sleeve.

23. A method in accordance with claim 22 further comprising the step of tightening a threaded nut on the propeller shaft to secure the propeller to the shaft.

24. A propeller assembly for being secured to a propeller shaft of a marine engine, said propeller assembly comprising at least a mating pair of limp home projections, said propeller assembly configured to operate in a normal operation mode wherein said limp home projections are separated from one another, a resilient operation mode wherein the separation of said limp home projections is decreased from the normal operation, and a limp home operation mode wherein said limp home projections are engaged to one another.

25. A propeller assembly in accordance with claim 24 wherein said propeller assembly comprises a resilient inner hub having a longitudinal axis, and wherein in said resilient operation mode, said inner hub twists along said hub longitudinal axis.

26. A propeller assembly in accordance with claim 24 wherein propeller assembly comprises a drive sleeve and an outer hub, and wherein in said limp home operation mode said drive sleeve and said outer hub are in direct contact.

27. A propeller assembly for being secured to a propeller shaft of a marine engine, said propeller assembly comprising:

means for engaging the propeller shaft comprising a drive sleeve comprising a cylindrical shaped body, a plurality of splines extending from an outer diameter surface of said drive sleeve body, said drive sleeve comprising a flange at one end of said drive sleeve cylindrical shaped body, a plurality of limp home projections extending from said drive sleeve flange;

a resilient means progressively engageable to said propeller shaft engaging means, said resilient means engaging said propeller shaft engaging means at a first end of said propeller shaft engaging means opposite a second end at which said propeller shaft engaging means engages said propeller shaft, a propeller comprising an outer hub comprising a cylindrical shaped body, and a plurality of blades extending from an outer diameter surface of said outer hub body, an inner diameter surface of said outer hub body shaped to mate with said resilient means at said second end of said resilient means opposite said resilient means first end engaged to said means for engaging said propeller shaft, a plurality of limp home projections extending from said outer hub inner diameter surface; and said first end of resilient means separated from said means for engaging the propeller shaft so as to prevent driving engagement thereof at said first end.

28. A propeller assembly for being secured to a propeller shaft of a marine engine, said propeller assembly comprising:

means for engaging the propeller shaft;

a resilient means progressively engageable to said propeller shaft engaging means, said resilient means engaging said propeller shaft engaging means at a first end of said propeller shaft engaging means opposite a second end at which said propeller shaft engaging means engages said propeller shaft, said resilient means comprising an inner hub comprising a cylindrical shaped body, and a plurality of grooves in an inner diameter surface of said inner hub body, each said groove arranged to receive one said drive sleeve spline, and a drive flange at one end of said inner hub body, and wherein said grooves in said inner diameter surface of said inner hub body are tapered;

a propeller comprising an outer hub comprising a cylindrical shaped body, and a plurality of blades extending from an outer diameter surface of said outer hub body, an inner diameter surface of said outer hub body shaped to mate with said resilient means at said second end of said resilient means opposite said resilient means first end engaged to said means for engaging said propeller shaft, and said first end of resilient means separated from said means for engaging the propeller shaft so as to prevent driving engagement thereof at said first end.

29. A propeller assembly for being secured to a propeller shaft of a marine engine, said propeller assembly comprising:

means for engaging the propeller shaft;

a resilient means progressively engageable to said propeller shaft engaging means, said resilient means engaging said propeller shaft engaging means at a first end of said propeller shaft engaging means opposite a second end at which said propeller shaft engaging means engages said propeller shaft, said resilient means comprising an inner hub comprising a cylindrical shaped body, and a plurality of grooves in an inner diameter surface of said inner hub body, each said groove arranged to receive one said drive sleeve spline, and a drive flange at one end of said inner hub body, said resilient inner hub is fabricated from plastic;

a propeller comprising an outer hub comprising a cylindrical shaped body, and a plurality of blades extending from an outer diameter surface of said outer hub body, an inner diameter surface of said outer hub body shaped to mate with said resilient means at said second end of said resilient means opposite said resilient means first end engaged to said means for engaging said propeller shaft, and said first end of resilient means separated from said means for engaging the propeller shalt so as to prevent driving engagement thereof at said first end.

30. A propeller assembly for being secured to a propeller shaft of a marine engine, said propeller assembly comprising:

means for engaging the propeller shaft;

a resilient means progressively engageable to said propeller shaft engaging means, said resilient means engaging said propeller shaft engaging means at end of said propeller shaft engaging means opposite end at which said propeller shaft engaging means engages said propeller shaft;

a propeller comprising an outer hub comprising a cylindrical shaped body, and a plurality of blades extending from an outer diameter surface of said outer hub body, an inner diameter surface of said outer hub body shaped to mate with said resilient means at end of said resilient means opposite said resilient means end engaged to said means for engaging said propeller shaft; and said resilient means comprising an inner hub comprising a cylindrical shaped body, a plurality of grooves in an inner diameter surface of said inner hub body, each said groove arranged to receive one said drive sleeve spline, and a drive flange at one end of said inner hub body and wherein said grooves in said inner diameter surface of said inner hub body are tapered.

31. A propeller assembly in accordance with claim 30 wherein said resilient inner hub is fabricated from plastic.

* * * * *

US006383042C1

(12) EX PARTE REEXAMINATION CERTIFICATE (5355th)

United States Patent
Neisen

(10) Number: US 6,383,042 C1
(45) Certificate Issued: Apr. 18, 2006

(54) AXIAL TWIST PROPELLER HUB

(75) Inventor: Gerald F. Neisen, Rockport, TX (US)

(73) Assignee: Outboard Marine Corporation, Waukegan, IL (US)

Reexamination Request:
No. 90/006,812, Oct. 20, 2003

Reexamination Certificate for:

| | |
|---|---|
| Patent No.: | **6,383,042** |
| Issued: | **May 7, 2002** |
| Appl. No.: | **09/547,009** |
| Filed: | **Apr. 11, 2000** |

(51) Int. Cl.
*B63H 1/14* (2006.01)
*B63H 23/24* (2006.01)

(52) U.S. Cl. ..... 440/49; 440/83; 416/134 R
(58) Field of Classification Search ..... 440/49, 440/79, 83; 416/93 A, 134 R, 245 A, 244 B
See application file for complete search history.

(56) References Cited

U.S. PATENT DOCUMENTS 5,244,348 A 9/1993 Karls et al.
5,322,416 A 6/1994 Karls et al.
5,484,264 A 1/1996 Karls et al.

*Primary Examiner*—Ed Swinehart

(57) ABSTRACT

A propeller assembly that includes an interchangeable drive sleeve, a resilient inner hub having a bore in which the drive sleeve is inserted, and a propeller including an outer hub in which the drive sleeve and resilient inner hub are inserted, is described. In an exemplary embodiment, the drive sleeve includes a cylindrical shaped body and a plurality of splines extend from an outer diameter surface of drive sleeve body. A bore extends through drive sleeve, and a plurality of grooves are in an inner diameter surface of the drive sleeve bore. These grooves are configured to mate with splines on a propeller shaft. Resilient inner hub includes a cylindrical shaped body and a plurality of tapered grooves in an inner diameter surface of the inner hub body. Each groove is arranged to receive one drive sleeve spline. The inner hub also includes a drive flange at one end thereof. The propeller includes an outer hub having a cylindrical shaped body, and a plurality of blades extend from an outer diameter surface of the outer hub body. An inner diameter surface of the other hub body is shaped to mate will the inner hub drive flange to limit relative movement between the inner hub drive flange and the outer hub.

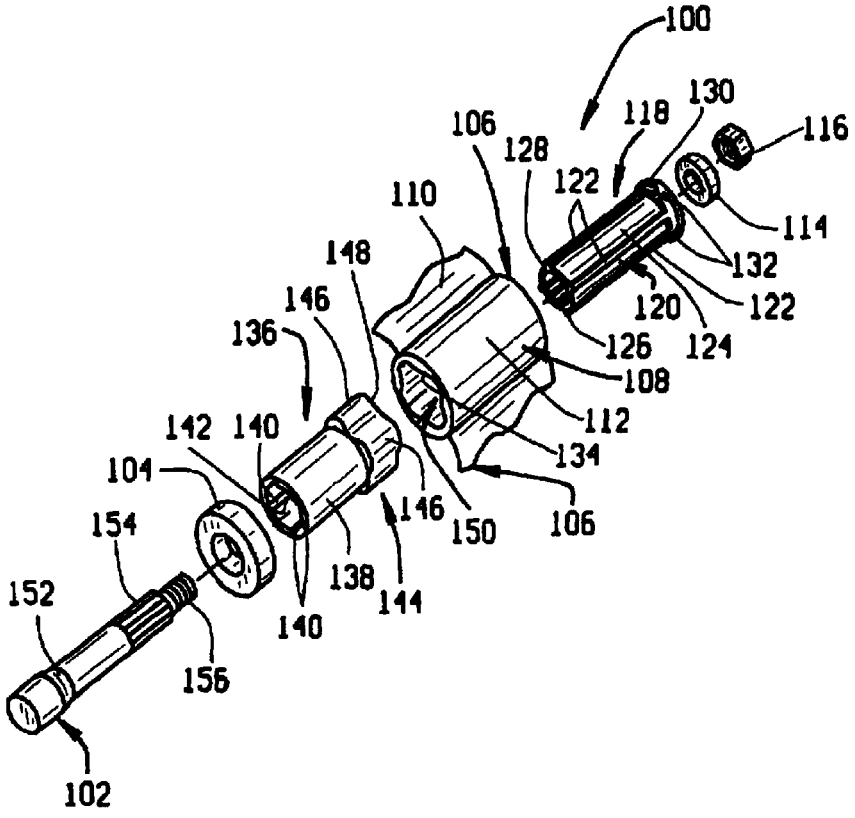

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–31 is confirmed.

* * * * *